US008143607B2

(12) United States Patent
Teodorescu

(10) Patent No.: US 8,143,607 B2
(45) Date of Patent: Mar. 27, 2012

(54) RECONFIGURABLE RADIATION SHIELD

(76) Inventor: Horia Mihail Teodorescu, Iasi (RO)

( * ) Notice: Subject to any disclaimer, the term of this patent is extended or adjusted under 35 U.S.C. 154(b) by 273 days.

(21) Appl. No.: 12/503,823

(22) Filed: Jul. 15, 2009

(65) Prior Publication Data

US 2010/0084586 A1 Apr. 8, 2010

Related U.S. Application Data

(60) Provisional application No. 61/134,867, filed on Jul. 15, 2008.

(51) Int. Cl.
*G21F 3/00* (2006.01)
*G21F 7/00* (2006.01)

(52) U.S. Cl. ..... 250/519.1; 250/505.1; 250/515.1

(58) Field of Classification Search ..... 250/505.1, 250/515.1, 516.1, 519.1
See application file for complete search history.

(56) References Cited

U.S. PATENT DOCUMENTS

| | | | | |
|---|---|---|---|---|
| 4,638,166 | A * | 1/1987 | Baudro | 250/515.1 |
| 5,981,964 | A * | 11/1999 | McAuley et al. | 250/515.1 |
| 6,571,852 | B2 * | 6/2003 | Toepel | 160/135 |
| 6,835,945 | B2 * | 12/2004 | Mossor et al. | 250/515.1 |
| 6,920,203 | B2 * | 7/2005 | Short et al. | 378/147 |
| 7,495,247 | B2 * | 2/2009 | Jorg | 250/517.1 |
| 2006/0159320 | A1 * | 7/2006 | Ritt et al. | 382/128 |
| 2009/0078891 | A1 * | 3/2009 | Oyaizu | 250/515.1 |
| 2009/0184269 | A1 * | 7/2009 | Rees | 250/516.1 |

* cited by examiner

*Primary Examiner* — Jack Berman
*Assistant Examiner* — David E Smith

(57) ABSTRACT

The disclosed invention proposes a reconfigurable radiation shield that, compared to art static shields, improves the protected volume/weight ratio. The reconfigurable shield is applicable in the medical field, in the aerospace industry, in mobile radiological laboratories and decontamination vehicles, as well as in other fields where intensity-fluctuating radiation and variable direction radiation represent a hazard.

5 Claims, 16 Drawing Sheets

RECONFIGURABLE RADIATION SHIELD

I claim benefit of provisional application 61/134,867 filed Jul. 15, 2008.

FIELD OF THE INVENTION

The field of invention is nuclear radiation protection. The invention solves the problem of a low weight nuclear radiation shield able to ensure an increased protection, equivalent to that produced by a more massive shield, when the radiation comes from fluctuating sources with well defined positions in the space.

The solution to the problem. The increase in protection is obtained by using an adaptive shield, with mobile elements and with adaptive shape, orienting the mobile elements in such a way as to produce the absorption required in the specified direction.

BACKGROUND OF THE INVENTION

1. Discussion of the Background Art

State of the art. Many designs of fixed, mobile or portable passive i.e. absorption—or "active" electrostatic or magnetic—i.e. deflecting—nuclear radiation shields are known in the literature, to protect the personnel and equipment from nuclear radiation coming from sources on the Earth, from the Sun, or from the cosmos. These shields are aimed to protect personnel and equipment from harmful nuclear radiation, including X radiation. In general, these shields are omni-directional, in the sense that they attenuate evenly radiation coming from any direction of space. The disadvantages of these shields are that they are massive and that they offer enough protection only when they have a large thickness and correspondingly high mass. Such shields are costly and, because of their high mass, are difficult to be used in space systems and, generally, in mobile systems. The known shields also have the disadvantage of the total lack of adaptability to the possible changes of the external radiation sources.

Especially for vehicles, for which the volume occupied by the equipments and the weight are essential factors, heavy and bulky shields are impractical. Moreover, for vehicles, the direction and the amplitude of the radiation sources are fluctuating and, in general, are unknown. Such vehicles are space vehicles, mobile radiological laboratories for medical or industrial use, and de-contamination vehicles. For such cases, an adaptive shield is needed.

Space vehicles represent a special case, as they require radiation shields adaptive to changes in the level of cosmic radiation. The adaptation could reasonably reduce temporarily the protected space in case of intense radiation, such that the protection is ensured for the personnel and for the most critical equipment, even if the comfort is decreased. Adaptive shields are also needed in the case of terrestrial vehicles, to ensure protection depending on the conditions on the terrain. Moreover, in the case of surface exploration vehicles, the shielding system will have to adapt to the Sun's movement relative to the planet's surface. Space stations can be considered a specific type of space vehicle, where long-duration stays make astronauts especially vulnerable to radiation. It is known that space stations, such as ISS, must be provided with "safe areas" where the personnel on the station can take refuge when dangerous solar or galactic radiative events occur. Vehicles for long space travels and stations on other planets or on satellites, as planned today for the near future, need safe areas that are well shielded to offer protection to the personnel under extreme space weather.

In general, in all situations where variable radiation sources are encountered, adaptive shields are required to achieve an optimal balance between the radiation protection and the volume of the protected space.

Even only for the psychical "safety" condition of people working in radiation conditions, such a shield would be desirable and useful.

It is known that space systems can be exposed, for short periods of time, to very intense fluxes of radiation, which come from well-defined directions from space, as the Sun or a particular galaxy. Such events happen during solar flares or during strong extra-solar nuclear activity—galactic or extragalactic, as supernovae explosions. Under these conditions, personnel or critical equipment onboard space systems are in major hazard. The hazard—probability of irradiation over a maximum acceptable dose—rises in case of extended space travel. Moreover, the inception and the development of space industrial activities and of space tourism impose reconsidering the problem of irradiation risks and of designing radiation shields that provide protection to passengers in conditions of large variability of space irradiation.

It is known that outside the space protected by Earth's magnetic field—outside the magnetosphere—radiation can accidentally become very intense. For example, it is known that between the missions Apollo 16 and 17, a strong proton radiation was produced, which, if astronauts were on route to the Moon, would have irradiated them with a lethal dose in less than 10 hours. It is also known that, during solar flares, X radiation—band 1.0-8.0 Angstrom—can reach the flux of $10^{-3}$ W/m$^2$, while in the absence of solar flares, its value is around $10^{-7}$ W/m$^2$—NASA, http://science.nasa.gov/headlines/y2000/ast14jul_2m.htm. Such increases, of up to four orders of magnitude, over short periods of time—minutes or hours—may endanger the lives of passengers of a space station, or space vehicle.

Due to the fact that radiation events are both rare and unpredictable, protection through massive omni-directional shielding is too costly. The cost of a radiation shield is a major factor in all instances in which radiation protection is required. In the case of shielding vehicles or portable equipment—for example, radiation protection clothing—mass is an essential factor. The problem exposed above is extensively dealt with in the recent volume "Space Radiation Hazards and the Vision for Space Exploration. Report of a Workshop" by the Ad Hoc Committee on the Solar Radiation Environment and NASA's Vision for Space Exploration; National Research Council of the National Academies, http://books.nap.edu/openbook.php?record_id=11760&page=R1, accessed Jan. 2, 2007). Similar problems are encountered on satellites that carry sensitive electronic equipment that must be protected in case of intense solar or cosmic radiation.

Thus, in space applications, it is important to use shields with reduced mass, which will ensure protection according to necessity, that is, it is important to use adaptive shields. The solution currently used onboard space systems is an omni-directional shielding that ensures radiation protection inside a small portion of the spacecraft, where personnel can retreat in case of a significant increase in irradiation. Similar problems arise in the field of terrestrial installations.

While power grid failures induced by space radiation are largely known to occur due to the high currents induced in the cables due to the change in the magnetic fields, some equipment such as transformers are known to be the most vulnerable. It is not yet well understood if the direct radiation plays a part in the failure of power transformers; but it is known that a direct radiation hit is able to change the properties of the oils in the transformer and thus it could prove that the direct radiation hit may also play a role in the power grid failures. Therefore, it may be of interest to shield such equipment to radiation. Because the radiation direction is not fixed, an adaptive shield may also be beneficial for protecting power equipments.

Various designs of radiation shields are known in the literature. These shields can be fixed, mobile, or even portable. Such shields are used in a variety of applications. Examples of shield designs are (Radiation protection shield for electronic devices. Inventor: Katz Joseph M. US2002074142-2002-06-20), (Radiation protection concrete and radiation protection shield. Inventor: Vanvor Dieter. TW464878-2001-11-21), (Radiological shield for protection against neutrons and gamma-radiation, Riedel J., GB1145042-1969-03-12), (Shield for protection of a sleeping person against harmful radiation. Inventor: Jacobs Robert. U.S. Pat. No. 4,801,807-1989-01-31), (Shaped lead shield for protection against X-radiation. Inventor: Hou Jun; Yunsheng Shi. Applicant: Hou Jun, CN2141925U-1993-09-08), (Filter for X Radiation, Inventor Petcu Stelian, 30.07.1996, Patent RO 111228 B1), (Radiation Passive Shield Analysis and Design for Space Applications, International Conference on Environmental Systems, Horia Mihail Teodorescu, Al Globus, SAE International, Rome, Italy, Jul. 11-15, 2005. SAE 2005 Transactions Journal of Aerospace, 2005-01-2835, March 2006, pp. 179-188). Other designs can be similar to designs of shields for other types of radiation; such designs are provided in (Shield device for the rear protection of an infrared radiation emitter apparatus, tubes and shields for implementing it. Inventor: Lumpp Christian, FR2554556-1985-05-10), (Shield for protection against electromagnetic radiation of electrostatic field. Inventor: Sokolov Dmitrij Yu.; Kornakov Nikolaj N., Applicant: Sokolov Dmitrij Yu.; Kornakov Nikolaj N., SU1823164-1993-06-23). All these designs are for fixed shields. Also, many materials and combinations of materials are known to be effective in radiation protection, for example (Patent RO 118913 B, Multi-layer screen against X and gamma radiation, Moiseev T., 30.12.2003), (Patent RO 120513 B1, X-ray absorbing material and its variants, Inventors: Tkachenko Vladimir Ivanovich, U A.; Nosov Igor Stepanovich, Ru; Ivanov Valery Anatolievich, U A; Pechenkin Valery Ivanovich, U A; Sokolov Stanislav Yurievitch, L V., 28.02.2006). Also, there are many manufacturers of radiation shielding plates and materials, for example (X-ray Protection Screen, Data Sheet, Apreco Limited, The Bruff Business Centre, Suckley, Worcestershire, WR6 5DR, UK., www.apreco.co.uk), (Premier Technology Inc., 170 E. Siphon Rd. Pocatello, Id. 83202, USA, Shielding Windows & Glass—Information & Tutorials, RD 50 X-Ray Protection Glass http://www.premiertechnology.cc/premier/RD50.cfm).

In a recent publication, "Space Radiation Hazards and the Vision for Space Exploration—Report of a Workshop", Committee on the Solar System Radiation Environment, Space Studies Board, Division on Engineering and Physical Sciences, National Research Council of the National Academies, 2006, Washington D.C., www.nap.edu, in Section "Operational Strategies for Science Weather Support", p. 47, FIG. 3.4, (http://books.nap.edu/openbook.php?record_id=11760&page=47), among other means for reduction of radiation, the following are proposed: passive shielding, [radiation] storm shelters, and reconfigurable shielding." However, no example of reconfigurable shielding is provided. The solution we propose goes beyond simple reconfiguration, moreover proposes a specific way to improve the efficiency of the shielding, while preserving the weight of the shielding as low as possible.

The necessity of fast deploying radiation shields whose shape is modifiable according to necessities was recognized and shields have been proposed that are composed of several movable shielding plates that can be position according to the necessity (Baudro, 1987), (Toepel, 2003). However, the arrangement of the component panels of the shield remain empirical and no specific manner of arranging them in connection to radiation dose minimization was presented in the patents (Baudro, 1987), (Toepel, 2003).

On the other hand, the minimization of the harmful radiation dose is a well established goal in medical applications of the nuclear diagnosis and treatment. The achievement of that goal was pursued in various technical solutions for the case of medical applications, especially for variable collimators (Short, 2005). Variable shape, reconfigurable collimators were proposed to achieve the said purpose. Short (Short, 2005) presented a radiation shield with variable attenuation that is essentially able to partly or completely interact with the radiation moreover that can change its structural properties at a microscopic scale in order to change its radiation attenuation. Short teaches a shield that is able to produce only intermediate levels of attenuation, between the attenuation provided when the slabs are perpendicular to the radiation propagation direction and zero attenuation.

However, the problem of applying specified distributions of radiation doses to specified parts of the patient body while using a radiation source or sources with well known positions and the problem of minimizing the radiation dose to personnel or equipment when the distribution of the radiation sources and the fluxes produced by the said sources are unknown and variable require different methods for reconfigurable the shielding. A highly adaptive reconfigurable shield and an appropriate adaptation method are needed in case of shielding against unknown, time-variable radiation sources as encountered in space. The adaptation should be performed for minimizing the radiation dose in the space delimited by the shield, while the space delimited by the shield must be at least a specified space to accommodate the protected personnel or the equipment.

The solution we propose solves the requirements above presented while departing from the known reconfigurable shields or collimators previously known. The solution relies on a specific way to improve the efficiency of the shielding by changing the arrangement of the shield elements, yet preserving the weight of the shielding as low as possible, where the improvement is obtained solely by increasing the thickness of the shield as apparent to the incident radiation.

2. The Technical Problem the Invention Solves

The first technical problem solved is the design of an adaptive radiation shield able to ensure an increased protection to radiation, especially when the radiation intensity and the direction from which the radiation comes are changing. The second technical problem solved is the design of the said adaptive radiation shield with a lower mass than a fixed shield made of the same materials.

The adaptive radiation shield and its constructive variants, as subsequently presented, according to the invention, solves the above-mentioned problems and eliminates or reduces the disadvantages of the classic designs.

BRIEF SUMMARY OF THE INVENTION

Our solution(s). The object of this invention constitutes an adaptive, directional radiation shield, capable of realizing—with relatively low mass—an elevated attenuation of radiation in a reduced space when the level of external radiation fluctuates either in intensity, direction of source, occurrence of multiple sources, or in nature of radiation. The protected space will have variable dimensions, correlated with the intensity of the external radiation, such that, at a given level of external radiation and a given maximum dose admitted in the interior portion, it will have the largest volume. The shield is specially conceived to ensure protection in well-defined directions, specifically in directions of incidence of radiation coming from variable sources—placed at large distances, such as the Sun—or from sources that spontaneously emit strong doses of radiation.

The solution to the stated problems is based on the local adaptation of the shape of the shield and the increase of the radiation by the movement of the elements composing the shield such that the apparent thickness of these elements increases in the direction of the incoming radiation.

The shield produces a radiation absorption that varies for different directions of the incoming radiation, the adaptation consisting in increasing the absorption in the direction of the actual incoming radiation. The protected space may be slightly diminished during the adaptation. The shield is aimed to adapt to strong and variable radiation sources placed at large distances, like the Sun and other celestial radiation sources.

The principal physical-geometrical effect explaining the operation of the adaptive shield consists in that that the change of position of an elongated body with respect to the direction of the incident radiation modifies the apparent thickness seen by the radiation and thus modifies the radiation absorption of the primary radiation. By building the shield with an ensemble of such elongated elements and by adjusting their position with respect to the incident radiation, an adaptive shield can be built. The position control can be performed in different manners, some of them exemplified in the present invention description. The mobile elements can be macroscopic parts of the shield, like plates or slabs, or can be microscopic elements constituent of the material of the shield, like in a ferro-fluid. In the second case, the material of the shield behaves as a controllable anisotropic material with respect to the radiation absorption.

BRIEF DESCRIPTION OF THE DRAWINGS

We include drawings to provide a further understanding of the invention. The accompanying drawings illustrate schematics of parts of the embodiments of the invention or embodiments of the invention, and together with the description serve to explain some of the principles and the operation of the invention in some of its various forms. Namely, the drawings represent:

FIG. 1 is a schematic cross-section view of an adaptive radiation shield before adaptation and with adapted shape, accordion-like modified.

FIG. 2 also shows the change of the travel distance of the primary-rays through the shield when the shape of the shield is modified in order to adapt.

FIG. 8 shows several schematic cross-sectional and perspective views of an adaptive shield protecting a cylindrical space, and the corresponding shield deformations during adaptation.

DETAILED DESCRIPTION OF THE INVENTION

Figure 1A:
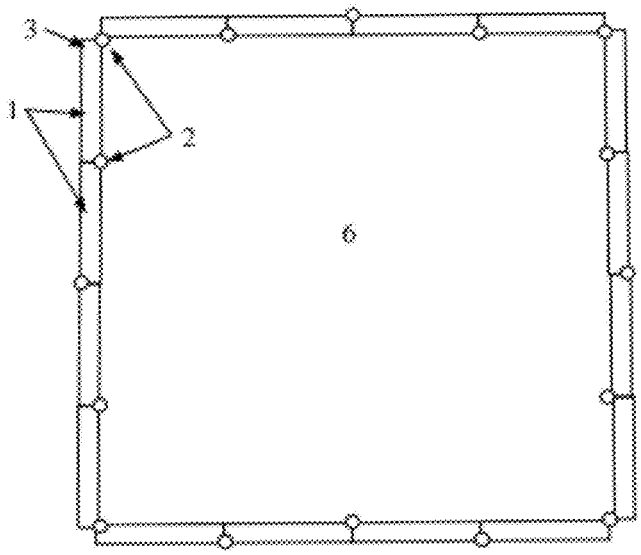
FIG. 1A shows a sketch of the initial (no or low radiation input) shape of a shield for a protected space with rectangular cross-section.

In a non-limitative version of realization, the radiation shield proposed herein consists of a set of articulated plates, slats or slabs, for example articulated with hinges, or with elastic articulations, such that the relative positions of the plates can be modified. The adaptive shield also includes radiation sensors, the necessary radiation measuring circuitry, a control system that controls the positions of the plates, and actuators to change the positions of the plates. In a non-limitative example of realization, the plates can have plane-parallel (thin parallelepiped, slat-, slab-) shape, and the assembly of plates encloses and protects an inside space of desired shape, for example, parallelepiped or cylindrical shape.

The main operating principle of the adaptive shield is described below. By modifying the tilt of the plane of an absorption plate with respect to the direction of incident radiation, the apparent width of the plate, as seen by the radiation, that is, the distance traveled by the primary radiation through the plate, is modified. Namely, if the actual width of the plate is d, then by inclining the plate with an angle θ, the distance traveled by the radiation through the plate becomes $\delta(\theta)=d/|\cos\theta|$. At large inclination angles, the equivalent increase of the absorption depth may increase by a factor of 10 with respect to the actual width of the plate. Consequently, the attenuation of the primary radiation is correspondingly increased. In this description, we do not analyze the problem of secondary radiation, which can be dealt with using appropriate materials known to the art for a two-section shield. The absorption produced by the plate is governed by the absorption law $$\Phi(\theta)=\Phi_0\cdot e^{-k\delta(\theta)}$$

where k is the absorption coefficient, which is dependent of nature of the radiation, of the spectral composition of the radiation and of the nature of the absorption material of the plate. Above, $\Phi_0$ is the incident radiation flux, and $\Phi(\theta)$ is the radiation flux passing beyond the shield, at an inclination angle θ of the plate with respect to the incident radiation. For example, for an inclination of 60° of the plate with respect to the direction of the incoming radiation, $\delta(\theta)=2d$, therefore the attenuation increases by a factor of $$e^{-kd}/e^{-2kd}=e^{kd}$$

with respect to the case of the plate normal to the radiation direction. For large inclinations, for example of 80°, one obtains $\delta(\theta)=d/|\cos\theta|\approx 5{,}75\cdot d$. Correspondingly, a reduction of radiation by a factor of $e^{4.75d}$ is obtained, compared to the case of normal incidence of the radiation.

The absorption plates may be realized of materials with uniform composition and absorption, or from composite materials, or of layers of different absorption materials, or of several plates with different absorption properties, in such a way as to efficiently absorb both the primary and the secondary radiation. The adaptive shield invention does not claim any specific material for shielding. Any known radiation-absorbent material can be a candidate for the design of the plates composing the shield. The purpose of the invention describing the basic shield with movable plates is to improve the efficiency of shields in an adaptive manner, not to devise new materials for shields.

Figure 1B:
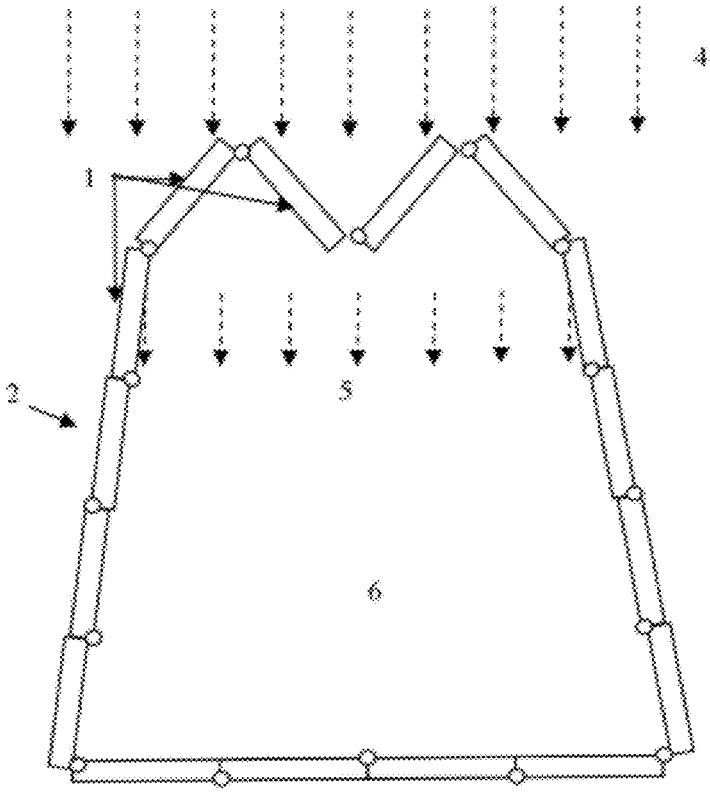
FIG. 1B shows the adapted shape of the shield in FIG. 1A.
Figure 2:
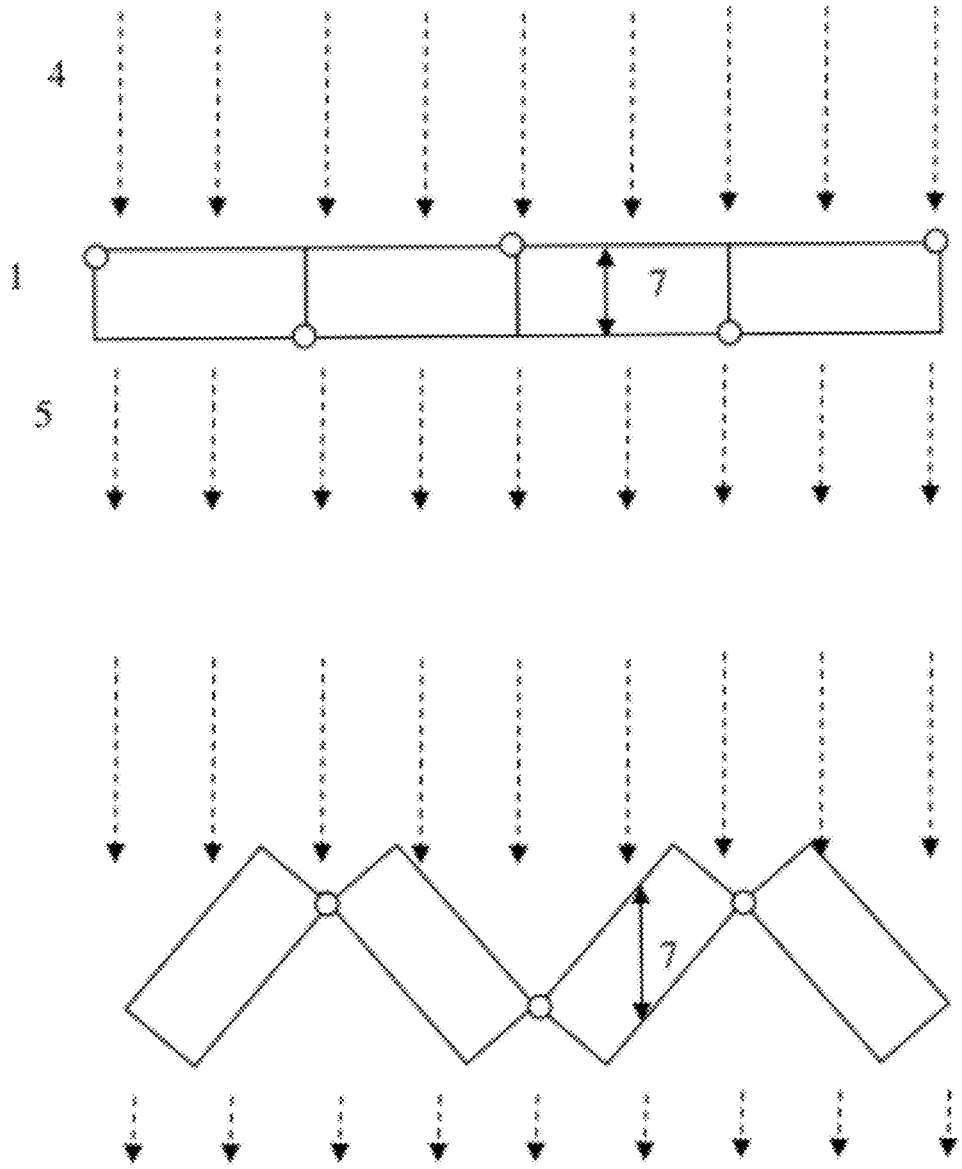
FIG. 2 is a schematic cross-section view of a non-limitative example of shield wall composed of several plates, slabs or slates articulated by hinges.

Subsequently, in connection to FIGS. 1, 2 and 3, we present a non-limitative example of realization for the adaptive radiation shield and we describe the operation and adaptation principle. FIG. 1 illustrates a non-limiting example of shield composed of radiation absorption plane-parallel plates (1), slates or slabs, connected through joints (2). The joints (2) can be any type of hinge, mechanical joint, or elastic articulation that allows the relative change of position of the plates, slabs or slates (1). The assembly of the plates is forming the adaptive shield (3). The sketch in FIG. 1 represents a non-limiting version of the adaptive shield that initially delimits a space of square transversal section. As a consequence of the increase of an incident radiation (4), the shield modifies its shape in order to reduce the effect of the radiation in the delimited protected space. The plates attenuate the incident radiation (4) in order to reduce the level of the internal radiation (5) to an acceptable level, thus protecting the inside space (6) delimited by the shield. FIG. 2 illustrates the distance (7) traveled by the radiation through the plates, distance that represents the effective, apparent (not geometrical) thickness of the shield. That thickness is modified by the inclination of the plate with respect to the incident radiation, by a factor of $1/|\cos\theta|$. In this way, the radiation that penetrates in the protected space is reduced.

Figure 3:
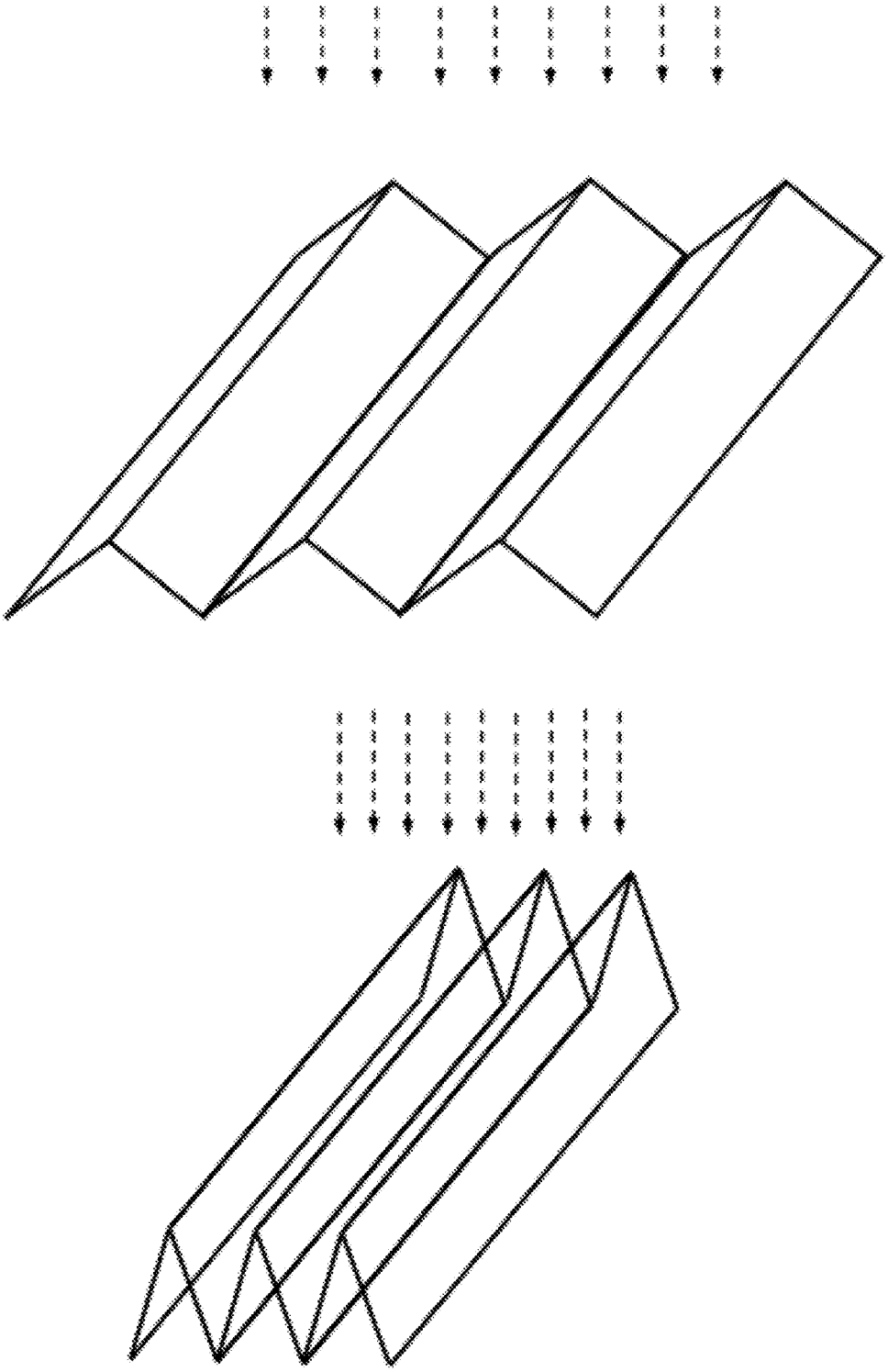
FIG. 3 is a schematic perspective view of a non-limitative example of shield wall composed of several articulated slabs or slates, moreover of the change in shape of the shield wall when the incoming radiation intensity changes.

The assembly of plates (1) of the adaptive shield (3) can take the form of a spatial zigzag, with variable angles between the articulated plates, as illustrated in FIG. 3. The articulations can be made with hinges or with elastic materials, or with any other known means.

Figure 4:
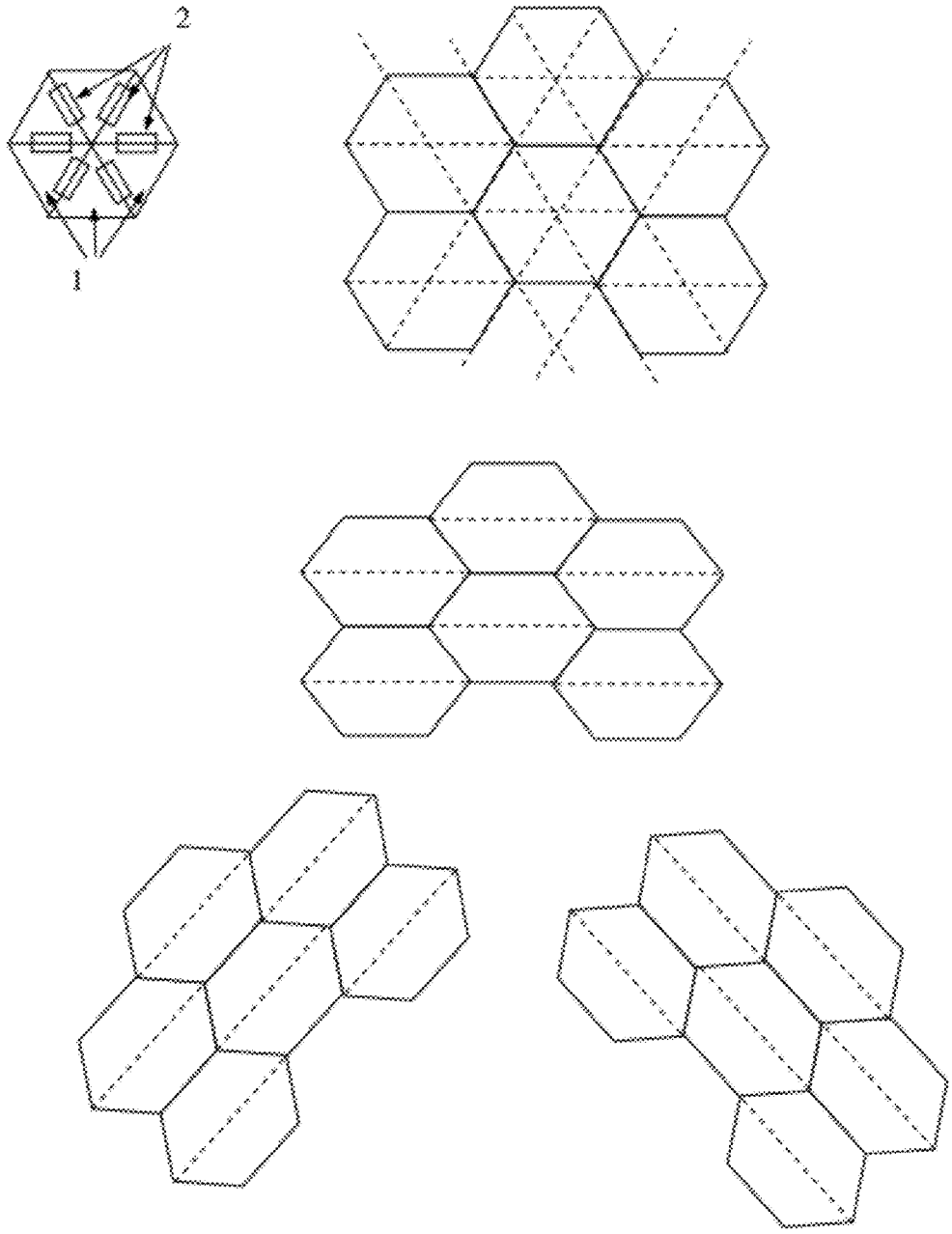
FIG. 4 is a schematic projection view of a non-limitative example of shield wall, composed of several articulated slabs or slates. The slabs are composed of equilateral triangles forming a basic regular hexagonal tiling. When the incoming radiation increases, the tiling is deformed to a 3-dimensional tiling whose projection represents a planar non-regular hexagonal tiling. The shape change is possible in any of the three directions corresponding to the three "diagonals" of the basic hexagon, such as to better adapt to the radiation direction.
Figure 5:
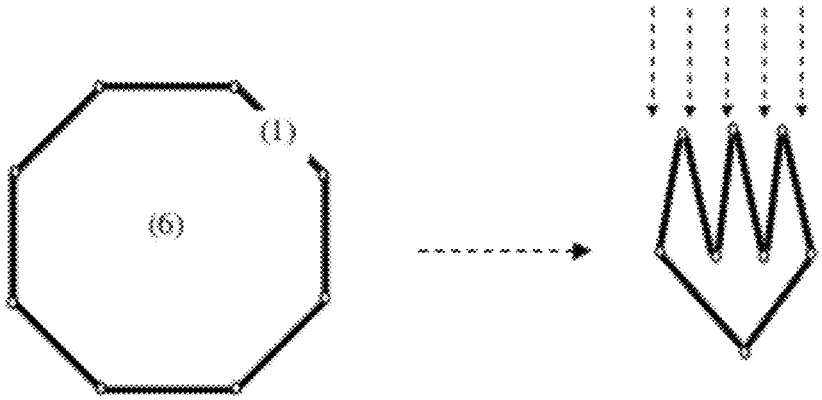
FIG. 5 is a schematic cross-section view of an adaptive radiation shield before adaptation and with adapted shape; the initial cross-section is a regular polygon.
Figure 6:
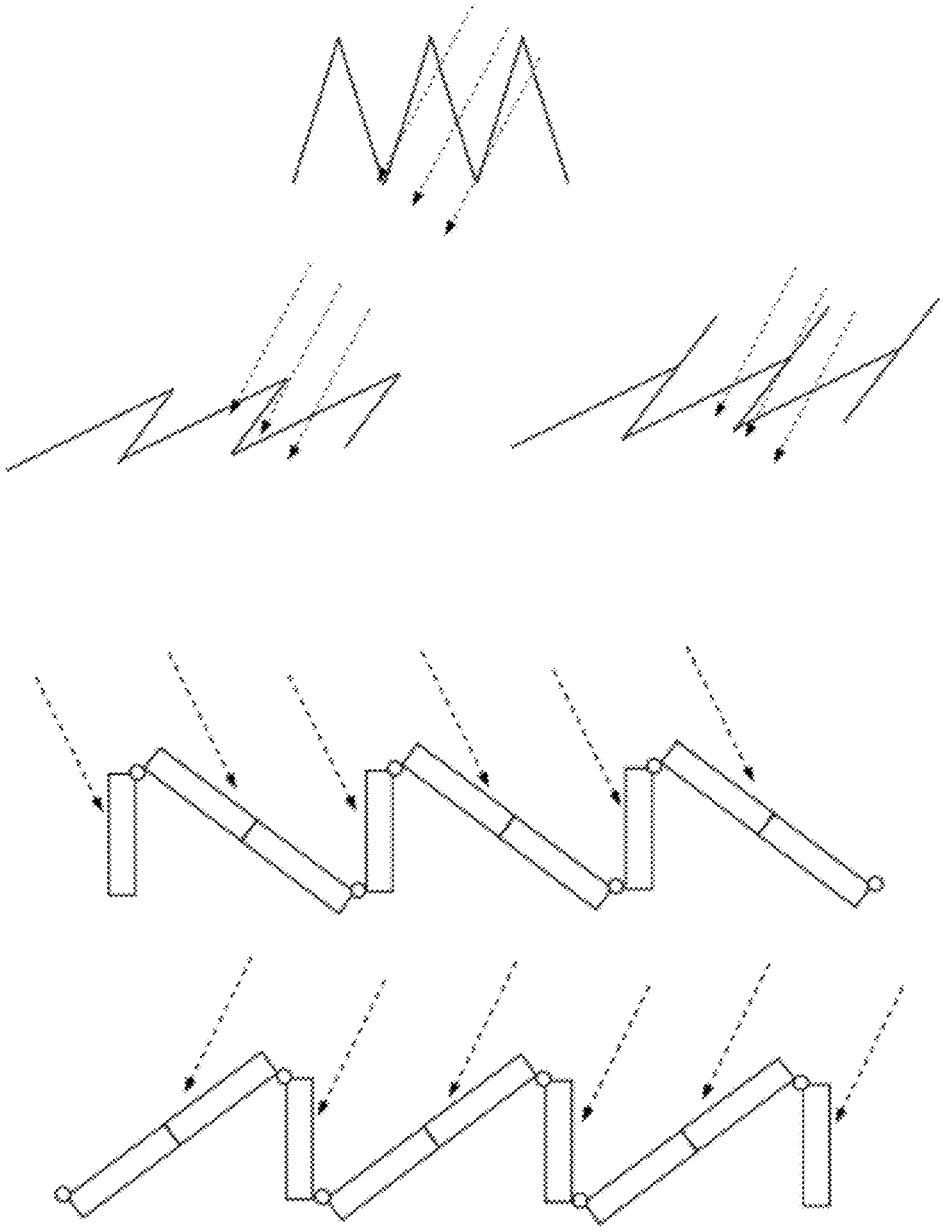
FIG. 6 shows several schematic cross-sectional and perspective views of adaptive shield walls composed of articulated slabs or slates, with fixed and sliding hinges, moreover of the change in shape of the shield wall when the incoming radiation direction changes.
Figure 7:
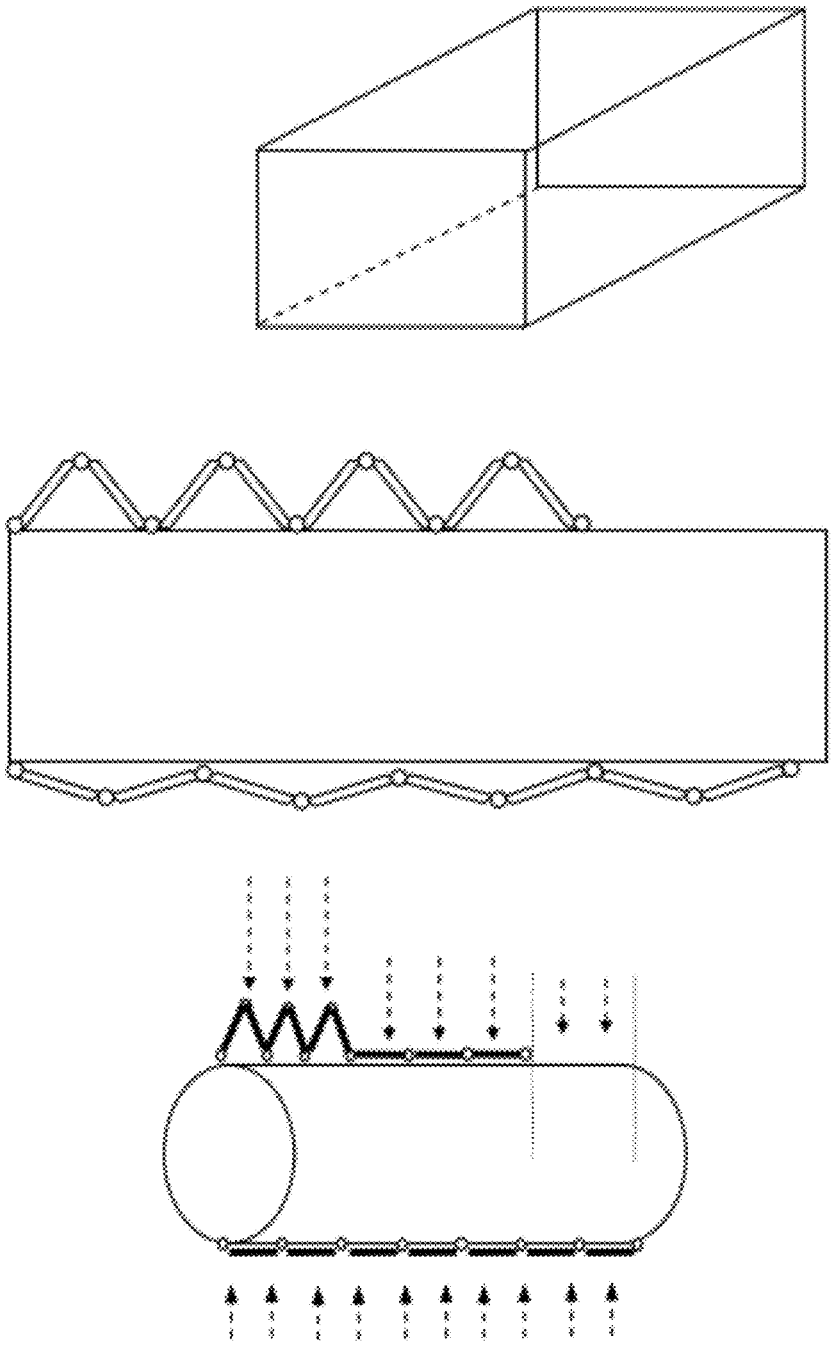
FIG. 7 shows several schematic cross-sectional and perspective views of adaptive shields protecting parallelepiped or cylindrical spaces, and the corresponding shield deformations during adaptation. The shield deforms in an accordion-type shape in the region in-need of radiation protection, with no deformation in the other regions.
Figure 8A:
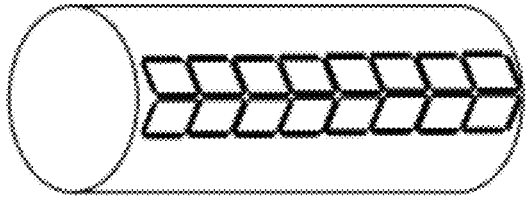
In FIG. 8A, each row of horizontal or vertical slabs can move individually. In a non-limitative example, the hinges between each pair of slabs can be of knuckle-joint type.
Figure 8B:
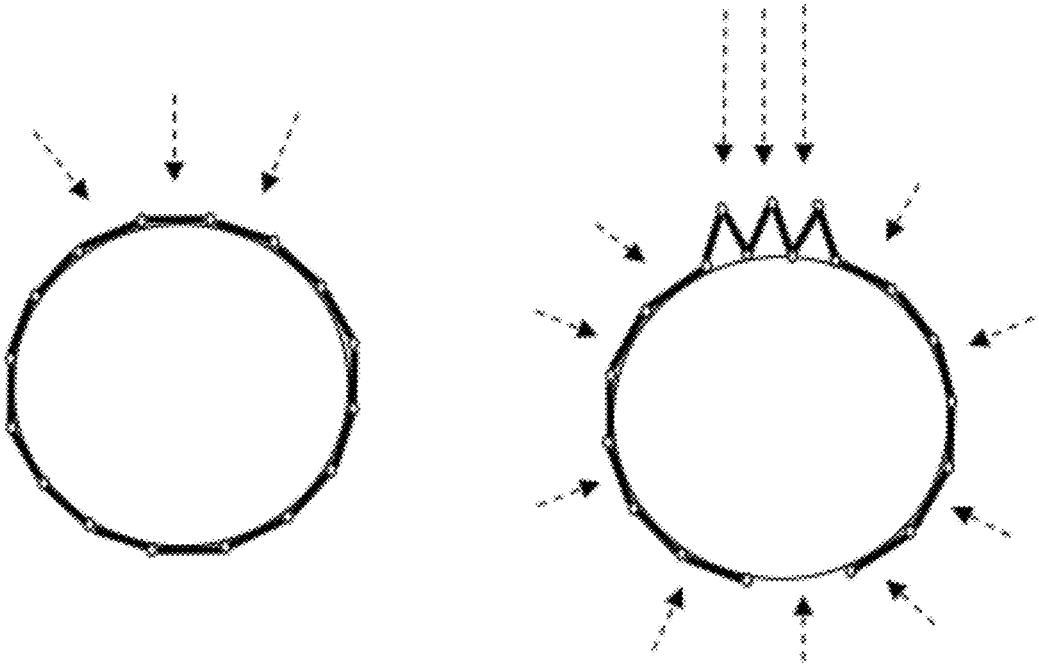
FIG. 8B shows the cross-sectional views of a cylindrical protected space and of an adaptive shield before and after adaptation to a prevalent directional radiation source.

Various configurations of the shield and shield plates can be used. As a matter of example, FIG. 4 shows a shield formed of equilateral plates that compose a hexagonal tile. This tiling configuration allows the deformation of the shield in three directions, allowing for more adaptability, which is very convenient when the direction of the radiation changes. FIG. 5 illustrates how a regular polygonal section of the shielding allows for a large interval of values for the angle between the plates, when transforming the convex polygonal section into a non-convex one. In FIG. 6 it is shown that a shielding folding based on a pattern of non-isosceles triangles (in cross-section) allows an improved attenuation by increasing the apparent thickness of the shield. Such patterns of non-isosceles triangles can be formed using slabs of the same width, but with a non-identical folding angle. Also in FIG. 6, upper panels, right, it is illustrated how slabs articulated by sliding hinges can deform to increase the apparent thickness. FIGS. 7 and 8 show various geometries of protected spaces and various types of shields with different deformation patterns; such cases can suit a large range of applications.

The position of the assembly of plates (1) that form the radiation shield (3) is automatically controlled by a measuring system that monitors the incident radiation at the exterior of the shield. The system may also measure the radiation entering in the interior of the shield. In conformity with these measured values, a control system and the related actuating (driving) devices adjust the position of the plates of the shield with the aim of reducing under an acceptable limit the radiation that enters the protected region. The control system includes for this purpose radiation sensors (8) placed externally with respect to the protected region, and possibly sensors (9) placed in the protected region (6). The sensors also determine the direction from which the dominant radiation flux comes, such that the protection is produced preferentially toward that direction.

Figure 9:
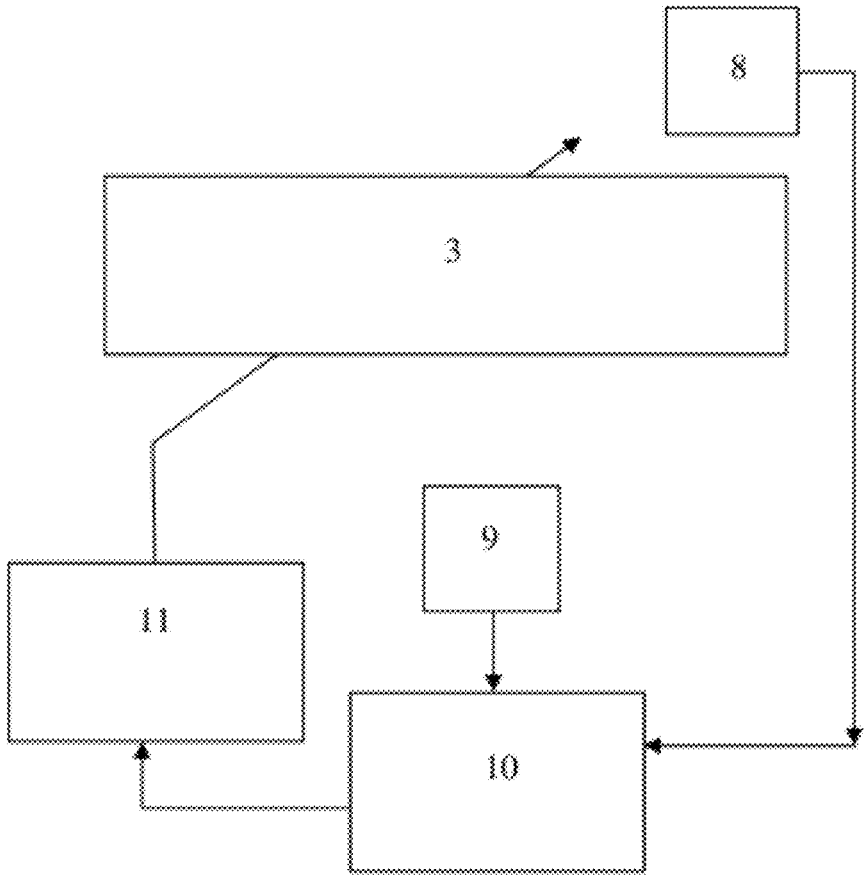
FIG. 9 is a schematic block diagram of a non-limitative example of adaptation control system.

The control system comprises, as sketched in FIG. 9, apart from the external (8) and internal (9) directional radiation sensors, a measuring system (circuits annexed to the sensors), and a digital control system (10), moreover a system (11) of actuating/driving the elements of the shield. The actuation system (11) may be mechanical, pneumatic/hydraulic, magnetic, electrodynamic, or of different nature. The automatic control system of the shield computes the optimal inclination angle for each of the plates, taking into account the radiation levels inside and outside the plate, as well as the geometrical constraints of the plate assembly. Apart from determining the optimal geometrical configuration of the plate system, the control system commands accordingly the plates' actuation system. The actuation system may be based on hydraulic or pneumatic pistons, or on electric motors and gears, or on systems known from the automatic curtain manufacturing, or on electromagnetic actuating systems.

The need for sensors to the inside of the protected space, possibly of sensors carried by the personnel, is due to the fact that the radiation in the protected space may vary from point to point, moreover secondary effects may be produced, such as the secondary radiation produced from the shield or from objects inside the protected space.

Figure 10:
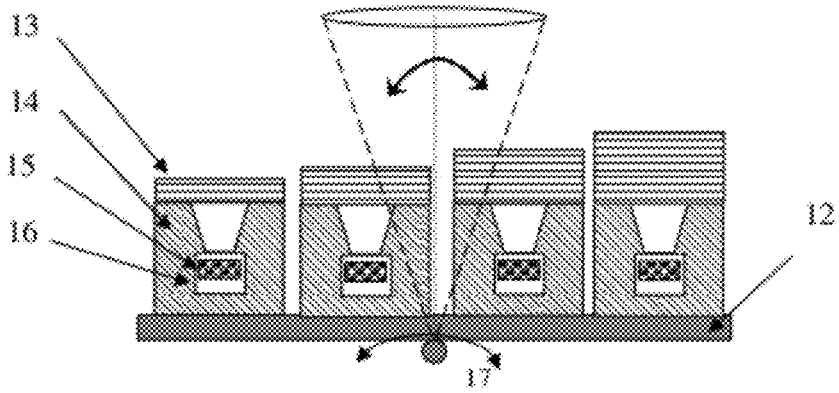
FIG. 10 is a schematic vertical-section view of a non-limitative example of a mobile system of radiation sensors with various shields and possibly included in a phantom, the system of sensors being able to scan the radiation coming from a wide solid angle.
Figure 11:
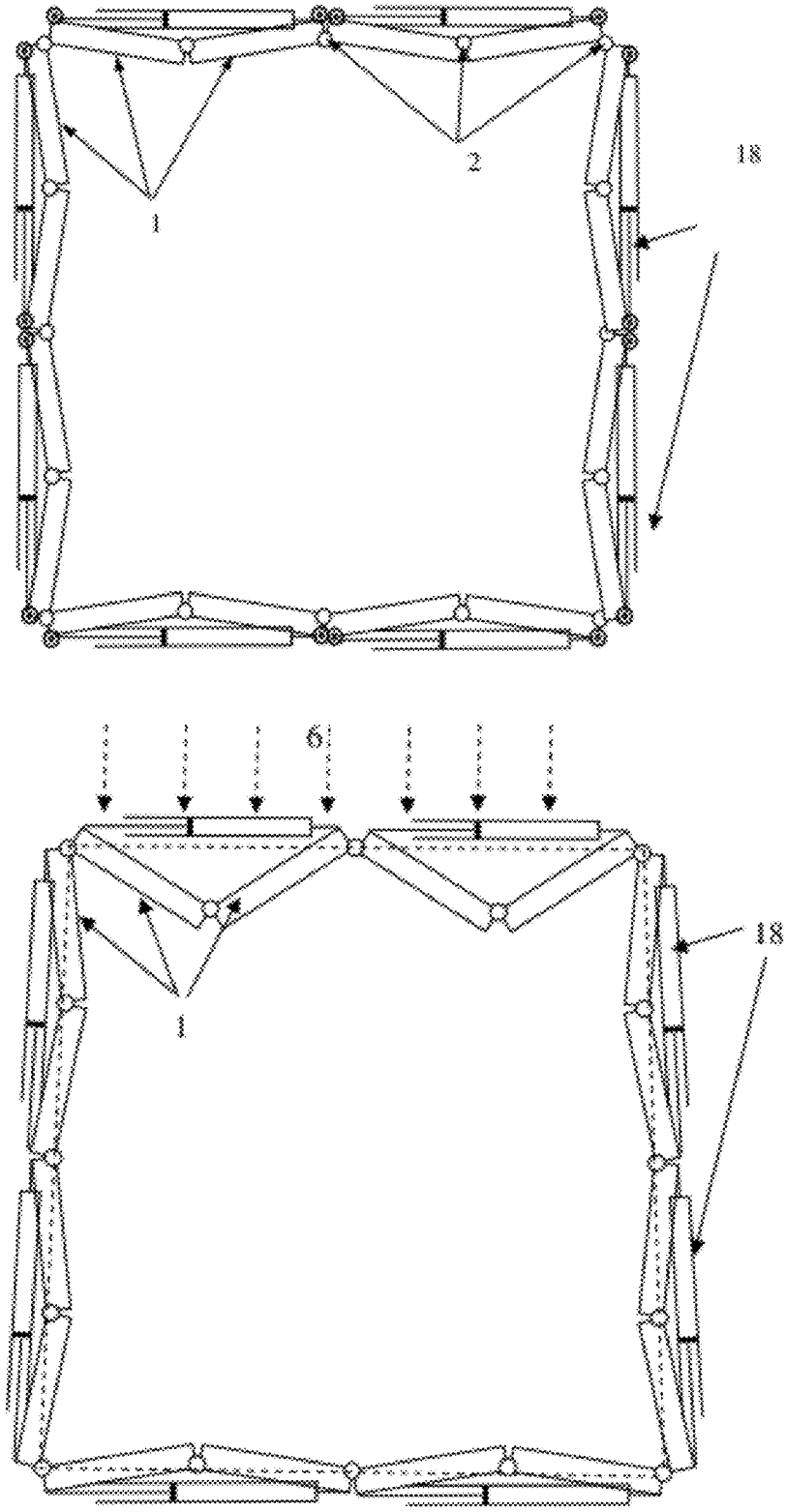
FIG. 11 shows a schematic cross-sectional view of an adaptive shield with plates moved by means of pistons placed outside the shield, with two positions of the shield, corresponding to the basic shape and respectively corresponding to adaptation to higher radiation intensity coming from the upper part of the figure.
Figure 12:
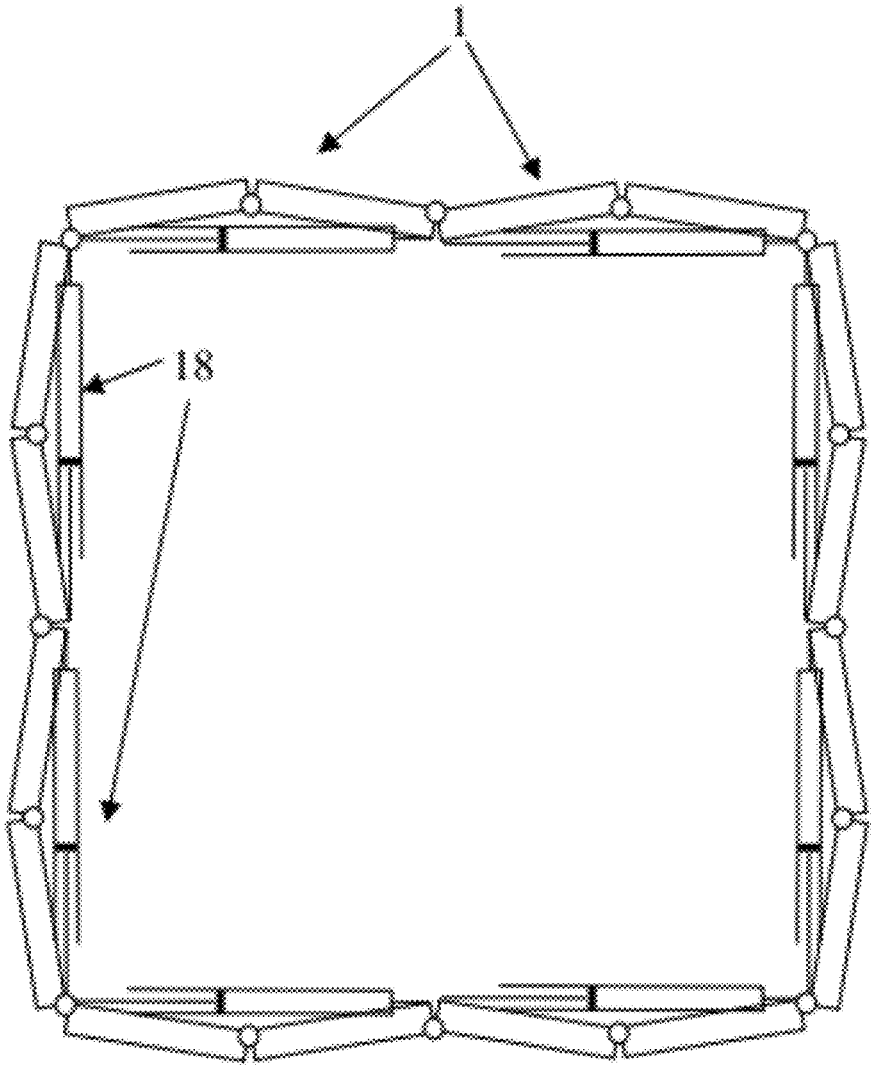
FIG. 12 shows a schematic cross-sectional view of an adaptive shield with plates moved by means of pistons placed inside the shield.
Figure 13:
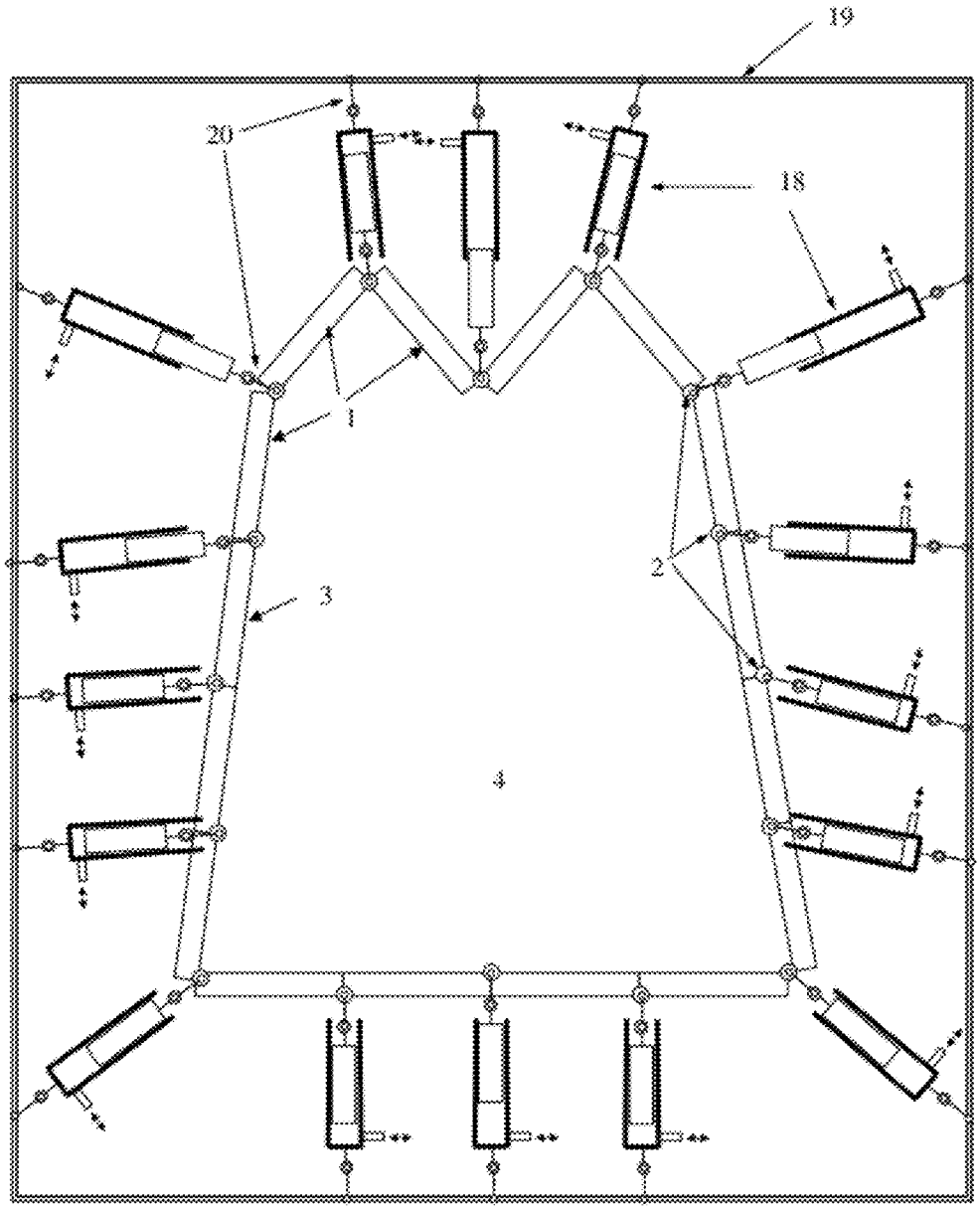
FIG. 13 shows a schematic cross-sectional view of an adaptive shield with plates moved by means of pistons supported by an external frame.

In a non-restrictive construction variant, the sensor is replaced by an assembly of sensors, as sketched in FIG. 10, mounted on a mobile support (12) such that, by the movement of the support, the sensor can scan and monitor a wide solid angle for the incoming radiation.

In yet another non-restrictive construction variant, instead of a single sensor, several sensors are used in a sensor array, mounted on a mobile support (12), the sensors comprising a plate (13) of pre-determined thickness realized from the same material or materials as the shield, a protecting shield (14) that prevents radiation from undesired lateral directions to penetrate to the actual sensor (15), the actual (electronic) sensor (15) being included in a sensor chamber (16) which, in a realization version, can consist of a phantom to model the absorption properties of the human body or of the equipment to be protected. The different thicknesses of the sensor shields (13) correspond, from the point of view of radiation dampening, to the dampening produced by specified shapes of the reconfigurable shield. The sensors may also be included in phantoms—such as to determine the radiation effect on the human body, rather than the radiation's physical effect. The use of phantoms is motivated by the need to determine overall—primary plus secondary—radiation effects. The energetic spectral information, total—primary plus secondary—internal radiation flux, and the direction information, are all fed to the controller in order to determine the best shape the adaptive shield must take.

The adaptation of the reconfigurable shield is performed according to a radiation dose minimization criterion with restrictions. The restrictions are related to the maximal dose in any of the monitored points in the space delimited by the shield. As a matter of example, in case the shield protects a single person, the dose in various regions of the body of the person must all be submitted to a radiation dose less than a specified value, while the sum of doses received by the whole body must be minimized. Assuming the radiation is monitored inside the delimited space by sensors connected to the head, upper abdomen, lower abdomen and legs, the optimization problem with restrictions is expressed as: Reconfigure shield such that to minimize the total dose $\Sigma_k D_k w_k$ subject to the conditions $D_k < D_{k_MAX}$, where $D_k$ are the measured doses per unit surface in the body region k, $D_{k_MAX}$ are the corresponding maximal doses allowed, and $w_k$ are weights related to the total surface of the corresponding region of the body.

This method of adaptation differs to those previously proposed. Baudro invented a radiation shield composed of interconnected slants, which can be easily deployed, the deployed shield having a support that is also collapsible and easily deployable. The deployed shield has essentially a predetermined planar shape and, according to the drawings in the quoted patent is positioned normal to the radiation propagation direction. This position of the plates is not favorable for radiation attenuation, as explained above. Toepel invented a radiation shield composed of hinged plates. In Toepel's invention, the position of the panel, as represented by the angle between the panel plane and the direction of the incident radiation plays no role. In contrast, our invention essentially relies on the control of that angle. Short presented a radiation shield with variable attenuation that is essentially able to partly or completely interact with the radiation moreover that can change its structural properties at a microscopic scale in order to change its radiation attenuation. Short teaches a shield that is able to produce only intermediate levels of attenuation, between the attenuation provided when the slabs are perpendicular to the radiation propagation direction and zero attenuation. Therefore, Short's shield and shield adaptation method can not increase the attenuation over the level obtained when the slabs are perpendicular to the radiation direction. The significant distinction of the shield described in this invention compared to the state of the art is that it teaches a method to significantly improve the attenuation above the level achieved when the slabs are perpendicular to the radiation direction. The increase in attenuation, according to the present invention, is, however, obtained in general by a decrease of the volume of the protected space.

Example 1

In this example, the actuation system consists of hydraulic/pneumatic pumps (25), driven by motors (24), and connected through flexible tubes (26) to a set of pistons (18) such that each piston can be individually controlled by the control system (10). The digital control system (10) may be, in a non-limitative example, a microcontroller. The microcontroller is connected through power circuitry to the set of motors that drive the pumps. Each piston (18) is connected to an external frame (19) and to a joint (2) of the shield. The joints are alternately disposed, as to allow for the deformation of the shield structure. This example uses twice the number of pistons, pumps and motors required by the example in FIG. 1.

Figure 15A:
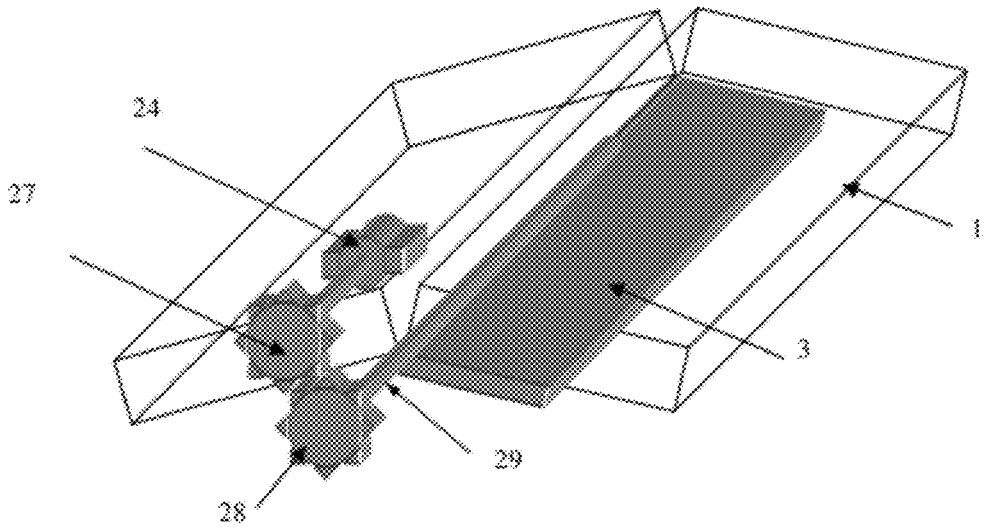
FIG. 15 is a schematic view of actuator for the plates of the shield, the actuator being based on an electric motor and wheels.
Figure 15B:
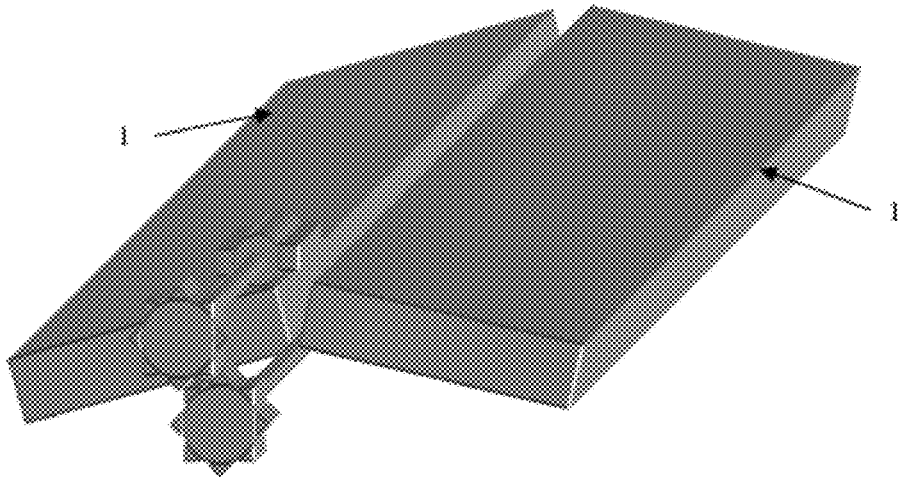

FIG. 15 A illustrates the sketch of a shield with hydraulic or pneumatic actuators, each used to move two successive plates. The actuators are externally placed with respect to the shield. As each piston corresponds to two adjacent plates (1) of the shield, there is no need for an external frame to the shield.

FIG. 15 B shows the sketch of a shield with hydraulic or pneumatic actuators, each used to move two successive plates. The actuators are internally placed with respect to the shield, in contrast to FIG. 3.

The details are provided as examples, for the easy understanding of the main ideas in the description. The actual realization needs not follow any of these examples.

Example 2

Figure 14:
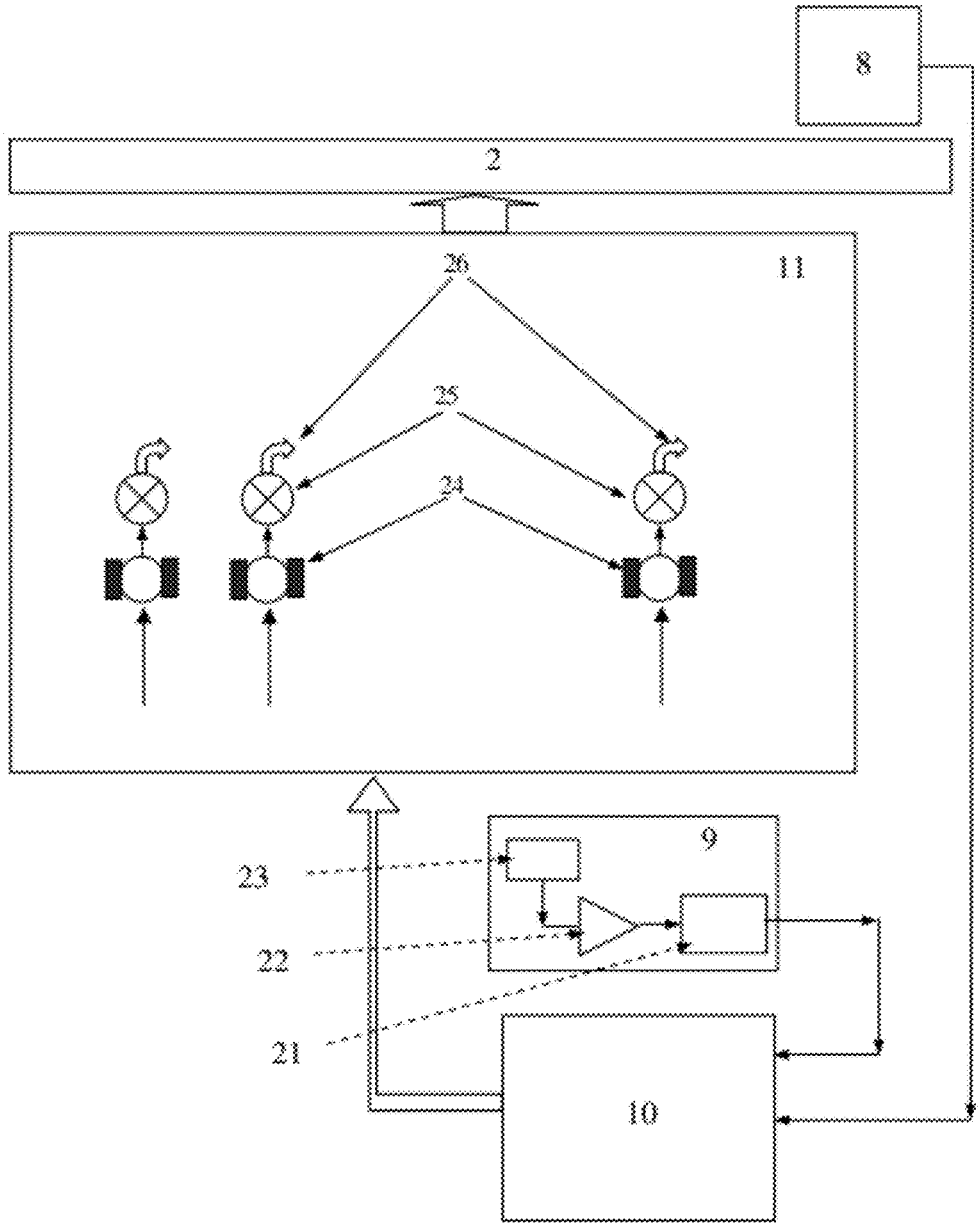
FIG. 14 is a detailed schematic block diagram of a non-limitative example of adaptation control system for the control of the adaptive shields using pneumatic or hydraulic pistons.

The joints of the shield assembly may be driven, in a non-limitative example, by gears driven by electric motors. The electric motors (24) actuating the elements of the shield are fixed directly to one of the plates in each couple of successive plates connected by hinges (one motor on every second plate). The digital control system (e.g. microcontroller) controls the motors (24) through an appropriate high current driver. FIG. 14 shows a detailed view of a sensor assembly (9), including an OPAMP (operational amplifier) (22), the elementary sensor (23) and the signal conditioning (24). FIG. 15A shows the motor (24) driving the first wheel (27) of the gear. The second wheel (28) of the gear is connected to the axis (29) of the hinge. Such a gear mechanism can be used to rotate two successive plates. (FIG. 15A shows only one section of the hinge.)

Skilled mechanical and electrical engineers can design, using current CAD tools, various joint elements, pneumatic, hydraulic, and electro-mechanical actuators, as well as driving and control circuitry. These elements are known to the art and are not patentable parts of the proposed system, although they are needed for the actual realization of some variants of the proposed system. Some of these elements can be purchased as commercially available parts.

Example 3

In another non-restrictive construction variant, the shield is made of an elastic material, such as rubber with an elevated content of radiation absorption material, elastic material that may be deformed and adapted in terms of shape according to the requirements of optimal protection. In contrast to Example 1, this variant does not need hinges, but needs means to fold the elastic material and to guide the folds according to a specified shape of the shield. Means to fold can be laces pulled by wheels/pulleys driven by electric motors.

The anti-radiation shield also behaves adaptively in the case of two or several directional radiation sources. In that case, the angle formed by the successive plates, or the shape of the elastic shield—if the shield is made out of elastic material—is controlled depending on the directions and intensities of the two sources of radiation, aiming to maximize total absorption of the radiation coming from the two sources. I further disclose elements suitable for one or several realizations.

In another non-limiting realization, at least some of the radiation sensors inside the protected space are worn by the protected personnel. In this case, the control information for the shield comes directly from the personnel and the shield orients such that it offers the best protection in those work areas. Indeed, it is known that for shields of irregular shapes, the level of ensured protection is not the same in all points of the protected space. Therefore, especially in the case in which people modify their position in time, optimal adaptation is achieved depending on the positions of the protected people. Information flow from the people-borne sensors to the control system may be realized either through radio, infrared, or other communication method.

In another non-restrictive construction, the control system uses either only external sensors, case in which the system has to compute the level of radiation in the protected space, or uses only internal sensors, case in which the adaptation may be realized only depending on the information about the level of radiation in the protected space.

In another non-limiting design, the radiation shield is formed out of a primary, non-adaptive shield supplemented by a system of directional—adaptive shields—which ensure protection only in a specified direction. The adaptive shield can be temporarily moved toward the direction from where high intensity radiation comes from. Thus, the assembly comprising a primary, non-adaptive, omni-directional, and a supplementary adaptive shield includes mobile elements that allow for the displacement of shielding elements with respect to the direction from where temporary strong radiation occurs, the said displacement being performed such as to maximize the absorption of the radiation.

In another non-limiting design, the measuring system of internal/external radiation is supplemented with an alarm system triggered at the increase in radiation levels.

In another non-restrictive construction, in which the internal sensors are not carried by the personnel, the radiation shield may feature a system of position sensors for automatic detection of the position of the protected persons, such that the computation of the position of the plates or slates composing the shield the related computation of the shape of the shield is aimed to optimal radiation dampening in the work area of those persons.

The radiation shield is adaptive as it allows for the variation of the protected volume in order to ensure the radiation in the protected area below a maximum permitted value. Thus, in the case of an increase in incident flux, the shield can restrain the protected volume in order to ascertain the interior radiation flux under the specified "safe" value. In the event of a drop in external radiation flux, the shield can distend to allow for a larger protected volume.

If the protected structure is cylindrical, in a non-limitative design, the shielding system may use a single internal/external sensor—or a pair of sensors—one internal and the other external—able to move on a helicoidal path, such as to cover the entire protected surface.

In the case of radiation obliquely incident to the shield, the dampening effect of the shield may be reduced compared to the dampening for radiation of normal incidence. Therefore, for an obliquely incident radiation, the optimal shape of the shield is different than the optimal shape for normally incident radiation. In order to determine which one is the angle of incidence of the most intense radiation, the sensors (16) will be able to do a precession-type rotation (17). The optimal shield shape will be computed taking into account the radiation's angle of incidence.

On the same principle, radiation protection clothes can be conceived. "Radiation shield"-clothes can be manufactured out of fabrics that contain radiation-absorbing materials and have shapes that can be modified through controlled folding/contraction in the more-in-need of protection areas, or through controlled distension in the less-in-need of protection areas. The less-in-need of protection areas are characterized by a smaller radiation input. As described, the clothes obtain a larger apparent thickness in the high radiation input areas. The extension/contraction may be realized, in a non-limitative design, by pulling straps/wires in the fabric. The straps/wires are operated by a control system in a similar way existing clothes are manipulated to form pleats and folds, or current ripplefold system or accordia-fold system draperies are used.

In yet another version of realization of the shield, the plates or the elastic or textile material used to absorb the radiation may be realized of or covered in magnetic material, such as to confer them magnetic properties. The shield is coupled to a magnetic field generator, such that it is magnetized. By changing the position of the plates, the intensity of the magnetic field is increased in the vicinity of the plates and the charged particles constituting a component of the radiation will be at least partially deflected by the magnetic field.

It is well known that strong solar activity can cause major disruptions in the electric distribution energy. The application of adaptive shielding for critical buildings such as power plants might be useful in preventing similar disruptions in the future. In a non-limitative design, the building's walls (3) may be mobile and formed out of articulated plates (1). The adaptive shield's control system must also take into account the Sun's relative movement to Earth's surface. Thus, the shield will have to continually adapt in order to provide the best attenuation in the Sun's direction.

In all realizations, the radiation shield may be controlled according to an algorithm that minimizes the effect of primary or of total radiation on the people inside the protected space, taking into account the specific absorption coefficients of the human body and biological effects of radiation.

In the description of the invention up to this point, only the primary radiation case has been dealt with. Here, we add the solution for the case when the secondary radiation is also important, because of the high-energy primary radiation that produces secondary radiation in the shield. In the case of potentially powerful secondary radiation, the shield is composed of at least two layers, one used to absorb the energetic particles/radiation, and the second used to absorb the less energetic particles/radiation generated as secondary-radiation, the first said layer being realized from a material including heavy atoms, while the second including lighter atoms. The shield can also be realized of a composite or mixed material to ensure appropriate absorption of both high and low energy particles. Radiation-absorbing materials are known to the art and do not constitute the object of this invention.

Figure 16:
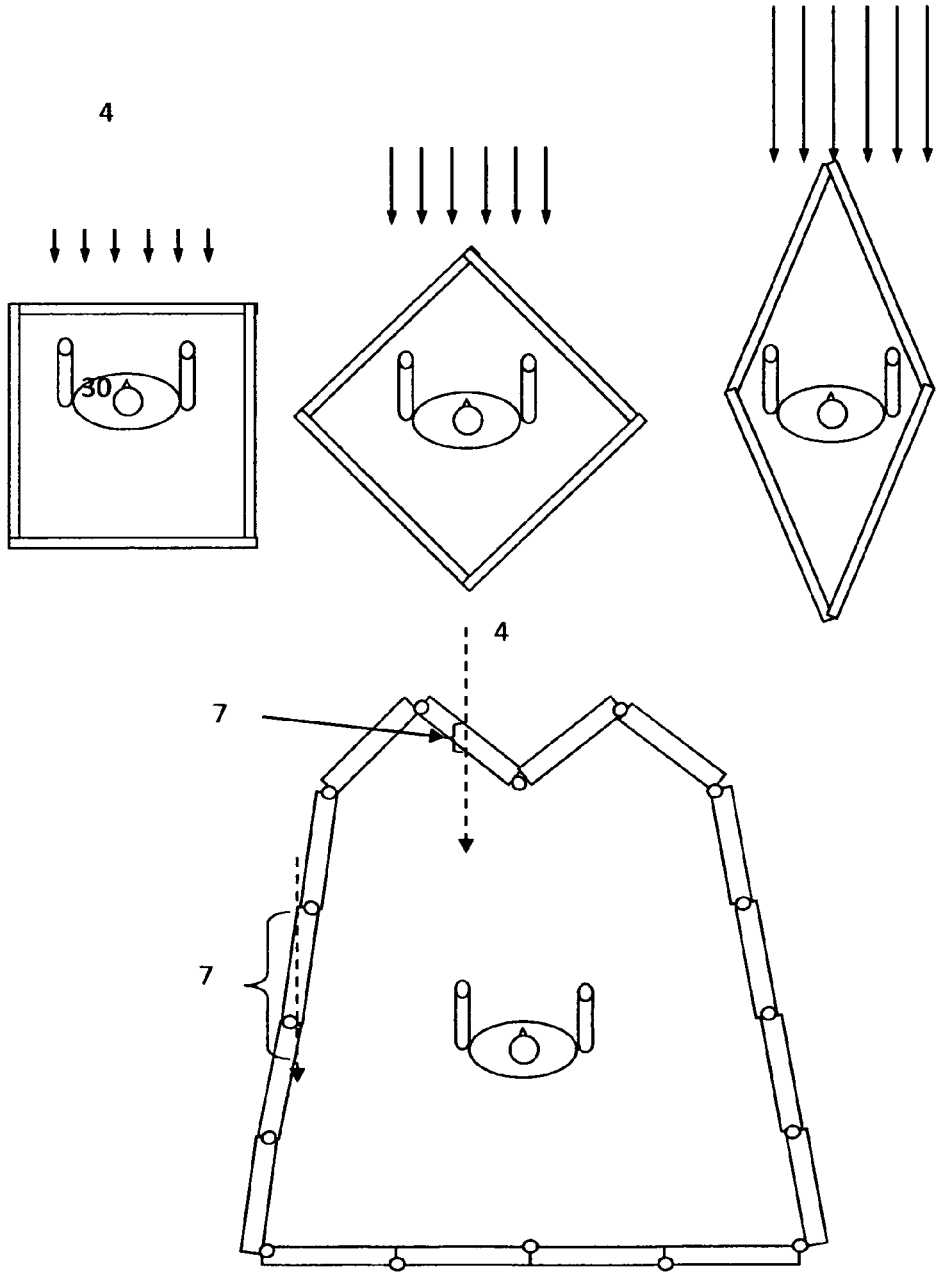
FIG. 16 exemplifies, based on several schematic cross-sections of examples of realizations of shields, the ways of increasing the protection by changing the position of the overall shield, or of the elements of the shield, or of both.

FIG. 16 summarizes the principle of the invention and provide further examples of adaptation. FIG. 16 illustrates a shield with rectangular initial shape that improves the protection of the personnel (30) either by global rotation of the shield without change in shape, or by both global rotation and change of shape, moreover compares the method of adaptation of the initially rectangular shield with the method of adaptation of the shield shown in FIG. 1.

The skilled reader will recognize the unity of the solution in all the variants. Indeed:

i) All variants are based on a single major idea, namely that change of orientation of a (macro-, micro-, or nano-) shield may strongly modify the radiation absorption. The idea is applied to macroscopic plates, to macroscopic elastic absorbing materials, and to textiles and absorbent draperies. Moreover, it is applied to devise "active" principles for non-homogeneous anisotropic materials that can be changed to adapt to the incoming radiation, ensuring best shielding.

ii) All the proposed embodiments, either macro- or micro-embodiments of the above idea serve the same practical purpose: reconfigurable radiation shields.

The radiation shield has several advantages. Among others, it ensures a significantly increased protection, at the same mass of the shield and the same materials composing the shield, compared with static, rigid, non-adaptive shields. Moreover, the shield operates automatically and implicitly can offer an alarm to the personnel occupying the protected space. To protect the personnel, the shield allows the temporary reduction of the protected space, when the levels of incoming radiation impose this situation. Compared to a static shield of the same mass, the disclosed reconfigurable shield improves the ratio (protected volume)/(weight).

INDUSTRIAL APPLICABILITY

The adaptive radiation shield can be industrially used in applications like space transport, in the medical domain, as well as in other terrestrial domains where intensity fluctuating radiation and variable direction radiation can be a hazard. The adaptive shield is technologically feasible with today means and with commercially available parts and materials. The precise design can be produced using existing CAD tools. In case of the adaptive shield variant based on ferro-fluids, it can be developed based on the current knowledge in the field, as reflected in the literature.

Although only a few embodiments have been described in detail above, those skilled in the art can recognize that many variations from the described embodiments are possible without departing from the spirit of the invention.

The skilled worker will recognize that the radiation shielding system presented is suitable with minor adaptations to various purposes, including the protection of personnel and patients in medical facilities, the protection of power equipment against unpredictably variable cosmic radiation, and in space applications.

REFERENCES CITED

U.S. Patent Documents

U.S. Pat. No. 4,076,387 02/1978 Haas et al.
U.S. Pat. No. 4,801,807 01/1989 Jacobs
U.S. Pat. No. 4,864,201 09/1989 Bernot
U.S. Pat. No. 7,152,653 12/2006 Kubly et al.

U.S. Patent Applications

US 2002074142 06/2002 Katz
US 2006278345 12/2006 Huang
US 2006272222 12/2006 Hoffmann et al.

Foreign Patent Documents

CN 2,141,925U 09/1993 Hou et al.
EP 1,733,660 12/2006 Gaetano
FR 2,554,556 05/1985 Lumpp
GB1,145,042 03/1969 Riedel
KR 20030029515 04/2003 Hintennach et al.
PL 376,077 12/2005 Janach
RO 111,228 B1 07/1996 Petcu
RO 120,513 B1 02/2006 Tkachenko et al.
RO 118,913 B12/2003 Moiseev
RO-00118094 07/2000 Romeo et al.
SU1,823,164 06/1993 Sokolov et al.
TW 464,878 11/2001 Vanvor Other Publications 1. Science in NASA's Vision for Space Exploration, Committee on the Scientific Context for Space Exploration, Space Studies Board, Division on Engineering and Physical Sciences, National Research Council of the National Academies, 2006, www.nap.edu
2. Space Radiation Hazards, Ad Hoc Committee on the Solar System Radiation Environment and NASA's Vision for Space Exploration: A Workshop, Space Studies Board, Division on Engineering and Physical Sciences, National Research Council of the National Academies, 2006, www.nap.edu
3. Evaluation of the influence of aircraft shielding on the aircrew exposure through an aircraft mathematical model. Ferrari, M. Pelliccioni, R. Villari, Radiation Protection Dosimetry 108:91-105 (2004), Oxford University Press
4. Cosmic Rays, R. A. Mewaldt, California Institute of Technology, http://www.srl.caltech.edu/personnel/dick/cos_encyc.html
5. Deadly radiation at and past the Van Allen Shields, David Wozney, http://internet.ocii.com/dpwozney/apollo5.htm
6. Radiation Hazards to Crews of Interplanetary Missions: Biological Issues and Research Strategies (1997), http://www.nap.edu/openbook/0309056985/html/28.html, 1997, 2000 The National Academy of Sciences
7. Radiation Passive Shield Analysis and Design for Space Applications, International Conference on Environmental Systems, Horia Mihail Teodorescu, Al Globus, SAE International, Rome, Italy, Jul. 11-15, 2005. SAE 2005 Transactions Journal of Aerospace, 2005-01-2835, March 2006, pp. 179-188.

8. Crew Habitable Element Space Radiation Shielding for Exploration Missions. Lockheed Engineering and Sciences Company, Contract NAS9-17900, Job Order K4-H13, Prepared by: P. D. Campbell, Principal Engineer, Flight Crew Support Department. ares.jsc.nasa.gov/HumanExplore/Exploration/EXLibrary/DOCS/EIC008.HTML
9. http://tiantong.en.alibaba.com/product/50214090/51171076/Tie_Rod_Hydraulic_Cyl inders/Tie_Rod_Hydraulic_Cylinder.html
10. Universul în radia ţie X. Emilia Tifrea, Alexandru Dumitrescu, Georgeta Mari Ş, Ed. Stiin ţifică Şi Enciclopedică, Bucure Şti, 1987
11. Robot Modeling and Simulation, Theodor Borangiu, Florin Ionescu, Editura AGIR—Ed. Academiei Romane, Bucure Şti 2002, pp. 368-371
12. Motordrape Exploded View CAD Drawing, http://www.btxinc.com/pdffiles/md1.pdf. Motordrape Overhead/Side View CAD Drawing, http://www.btxinc.com/pdffiles/md2.pdf, accesat 12 Dec. 2006. http://www.cinemasource.com/products/front_curtains/btx/btx.html.
13. Field-induced structures in miscible ferrofluid suspensions with and without latex spheres, M. F. Islam, K. H. Lin, D. Lacoste, T. C. Lubensky, and A. G. Yodh. Physical Review E 67, 021402 (2003), Issue 2—February 2003
14. Carbon Nanotubes Loaded with Magnetic Particles. Guzeliya Korneva, Haihui Ye, Yury Gogotsi, Derek Halverson, Gary Friedman, Jean-Claude Bradley, and Konstantin G. Kornev. Nano Letters 2005, Vol. 5, No. 5, 879-884
15. Manipulation of liquid droplets using amphiphilic, magnetic one-dimensional photonic crystal chaperones, Jason R. Dorvee, Austin M. Derfus, Sangeeta N. Bhatia, Michael J. Sailor, Published online: 7 Nov. 2004; Nature Materials, Advance Online Publication, www.nature.com/naturematerials

The invention claimed is:

1. A radiation shield system comprising:

An adaptively reconfigurable shield comprising a set of articulated rigid elements and/or a deformable shielding material, or a combination thereof;

Directional radiation sensors for monitoring an incident radiation intensity and determining the direction of incidence of the main radiation fluxes;

Means for controlling the shield shape;

And a computing system that determines a manner of adaptation based on the radiation amplitude and radiation direction readings of the sensors, Wherein the computing system is able to modify the angle between walls of the shield and the incident radiation and to globally modify the position of the shield by translation and rotation with respect to the room where it is confined and the personnel and equipment that the shield protects, So that the equivalent thickness of the absorbing material encountered by the radiation is large enough to offer the desired protection inside the region of space delimited by the shield.

2. The radiation shield system, as recited in claim 1, characterized by the fact that it further includes a system for the automatic detection of the positions of the protected persons, such that the shield adaptation is executed for minimizing the global primary radiation arriving in the region occupied by the personnel.

3. The radiation shield system, as recited in claim 1, has the directional radiation sensors placed outside the shielded space such that the adaptation is performed based on determinations of the incident radiation levels and directions outside the shielded space.

4. The radiation shield system, as recited in claim 1, has the directional radiation sensors placed inside the shielded space such that the adaptation is performed based on determinations of the attenuated radiation levels and directions.

5. The method as claimed in claim 1, wherein the shield adaptation is executed such that the minimization is performed with respect to a specified pattern of allowed radiation doses in specified regions of the space delimited by the shield.

* * * * *